US005881789A

United States Patent [19]

Melashenko et al.

[11] Patent Number: 5,881,789

[45] Date of Patent: Mar. 16, 1999

[54] CHILDRENS PLAY STRUCTURE

[75] Inventors: Robert A Melashenko; Connie R. Melashenko, both of Redlands, Calif.

[73] Assignee: Calapitter Creations, Inc., Redlands, Calif.

[21] Appl. No.: 928,157

[22] Filed: Sep. 12, 1997

[51] Int. Cl.[6] ..... A47G 5/00

[52] U.S. Cl. ..... 160/135; 52/281; 52/282.2; 403/217

[58] Field of Search ..... 160/135; 52/281, 52/282.2; 403/217, 219, 170; 40/124.2

[56] References Cited

U.S. PATENT DOCUMENTS

| | | | |
|---|---|---|---|
| 1,595,929 | 8/1926 | Rhodes | 160/135 |
| 1,661,003 | 2/1928 | Miller | 160/135 X |
| 2,011,528 | 8/1935 | Seay . | |
| 2,790,258 | 4/1957 | Freshour | 160/135 X |
| 2,895,717 | 7/1959 | Defalco . | |
| 3,204,689 | 9/1965 | Howell | 160/135 |
| 3,207,421 | 9/1965 | Hunger et al. . | |
| 3,247,628 | 4/1966 | Miller . | |
| 3,447,824 | 6/1969 | Brown . | |
| 3,571,999 | 3/1971 | Downing | 52/483 |
| 3,677,322 | 7/1972 | Brorson et al. | 160/135 |
| 3,709,237 | 1/1973 | Smith | 135/5 |
| 3,913,598 | 10/1975 | Glutting, Jr. et al. | 135/4 |
| 4,001,987 | 1/1977 | Couthard | 52/79.9 |
| 4,066,089 | 1/1978 | Rainwater | 135/3 |
| 4,121,645 | 10/1978 | Behr | 160/135 |
| 4,373,570 | 2/1983 | Nussdorf et al. . | |
| 4,516,620 | 5/1985 | Mulhern | 160/351 |
| 4,645,183 | 2/1987 | Rattray et al. | 256/25 |
| 4,667,724 | 5/1987 | Dragone | 160/135 X |
| 4,669,138 | 6/1987 | Kassai . | |
| 4,713,773 | 12/1987 | Larson | 256/25 |
| 4,798,019 | 1/1989 | Sury et al. | 43/1 |
| 4,842,035 | 6/1989 | Thompson | 160/135 |
| 4,884,988 | 12/1989 | McMurray | 446/115 |
| 4,992,068 | 2/1991 | Conrad | 446/85 |
| 5,069,623 | 12/1991 | Peat | 434/260 |
| 5,070,665 | 12/1991 | Marrin et al. | 52/239 |
| 5,287,909 | 2/1994 | King et al. | 160/135 |
| 5,352,149 | 10/1994 | Melashenko et al. | 446/478 |
| 5,382,111 | 1/1995 | Melashenko et al. . | |
| 5,414,950 | 5/1995 | Johnson, Jr. | 43/1 |
| 5,431,210 | 7/1995 | Nelson et al. | 160/135 |
| 5,544,870 | 8/1996 | Kelley et al. | 256/26 |
| 5,570,971 | 11/1996 | Rixen et al. | 403/381 |
| 5,694,997 | 12/1997 | Styger | 160/135 |

FOREIGN PATENT DOCUMENTS

| | | | |
|---|---|---|---|
| 2421585 | 12/1979 | France | 160/135 |
| 139467 | 4/1930 | Switzerland | 160/135 |
| 19737 | 10/1895 | United Kingdom | 160/135 |

*Primary Examiner*—Blair M. Johnson
*Attorney, Agent, or Firm*—Fish & Richardson P.C., P.A.

[57] ABSTRACT

A children's play structure includes a frame having hinge structures that enable the structure to be arranged into a free-standing structure having a variety of adjustable positions. Interchangeable panels can be provided for removable attachment to the structure. At least one of the panels may include an article mounting sheet configured to receive articles such as drawings, photographs, and the like in one or more transparent pockets. The frame is easily assembled and is foldable into a compact structure when not in use. A hinge mount structure having two mounting posts facilitates assembly, disassembly, folding, and adjustable positioning, and affords structural stability to the free-standing play structure. In particular, such a hinge structure allows adjoining frames to be mounted at the same level and to be freely pivoted independently of one another. Further, a coupling structure enables portions of the play structure to be divided into segments that can be attached upon assembly. The coupling structure enables the play structure to be reduced in size for shipment or storage.

22 Claims, 11 Drawing Sheets

CHILDRENS PLAY STRUCTURE

FIELD OF THE INVENTION

The present invention relates to children's play structures, and more particularly to play structures designed to provide the child with a particular theme or environment through the use of various scenes, murals or the like.

DISCUSSION OF RELATED ART

A child's play structure such as a playhouse or similar free-standing structure can be provided to enhance the child's play. Such structures are often provided with scenes, murals or the like which impart a particular theme or environment such as a school classroom, a doctor's office, a store, a spaceship or the like. The scenes or murals depict enough to suggest the desired theme or environment, while at the same time allowing the child to use his or her imagination with respect to some of the details. The child is thus able to act out various activities and sequences of events using the play structure as a prop.

Examples of children's play structures of this type are provided by U.S. Pat. No. 984,735 of Bailey, U.S. Pat. No. 4,919,982 of Hayes, U.S. Pat. No. 4,765,006 of Jackson, et al., U.S. Pat. No. 4,407,494 of Hummel, U.S. Pat. No. 1,881,356 of Gold, U.S. Pat. No. 3,548,552 of McBride, U.S. Pat. No. 2,837,777 of White, U.S. Pat. No. 2,608,726 of Olson, U.S. Pat. No. 1,982,433 of Hungerford, U.S. Pat. No. 1,647,733 of Keichline, U.S. Pat. No. Des. 159,019 of Valentine, U.S. Pat. No. 4,884,988 of McMurray, U.S. Pat. No. 4,696,652 of Reeder, et al. and U.S. Pat. No. 4,556,391 of Tardivel, et al. Such play structures are often made in a foldable or collapsible configuration so that they can be folded or otherwise substantially reduced in size to facilitate storage thereof when not in use. Such structures are assembled or erected to form a free-standing structure for use. As shown in some of the patents noted above, the play structures may form an enclosure to simulate a room or a house, and can be provided with partitions or other interior members which divide the interior into plural rooms, compartments or the like. Still other structures, such as the considerably smaller playhouse for use with paper dolls shown in the Hungerford patent noted above, provide different partitions or additions to change portions of the structure somewhere.

Although conventional children's play structures such as those described in the patents noted above provide a variety of different forms, themes, ideas and features, such structures are somewhat limited when it comes to their ability to easily convert to different themes, environments, or positional arrangements. Most such structures, for example, are designed to provide one and only one theme or environment with no interchangeability being possible. Still others provide for some interchangeability, but typically at the expense of complexity and an inherent difficulty in making the changes. In particular, the ease with which the structure can be adjusted, collapsed, and stored may be compromised. Accordingly, there is a need for a play structure that enables interchangeability while affording relatively simple and convenient positioning, assembly, and disassembly.

SUMMARY OF THE INVENTION

The present invention is directed to a children's play structure having a hinge mounting structure that facilitates assembly, disassembly, folding, and adjustable positioning while providing a stable, free-standing play environment.

The play structure includes a plurality of vertical bars and a plurality of horizontal rods extending between the vertical rods. The structure also may include a coupling structure that enables the vertical rods to be divided into segments for shipping or storage. The segments can be attached via the coupling structure upon assembly. A mounting structure on each of the vertical rods used for hinging has two mounting posts that enable horizontal rods to be mounted at the same level on the vertical hinge rod and pivoted independently of one another.

The play structure may include a plurality of panels depicting play scenes. The panels can be interchanged for variety. The panels also can be positioned in a variety of configurations via the hinge structure of the present invention, including positions providing a generally enclosed environment. Further, at least one of the panels may include a pocketed, article mounting sheet configured to receive articles such as drawings, reports, index cards, trading card, photographs, and the like in one or more transparent and/or apertured pockets.

The foregoing general description and the following detailed description are exemplary and explanatory only, and not restrictive of the present invention, as claimed. Other advantages, features, and embodiments of the present invention will become apparent from the following detailed description and claims.

BRIEF DESCRIPTION OF THE DRAWINGS

The accompanying drawings are included to provide a further understanding of the present invention and are incorporated in and constitute a part of this specification. The drawings help to illustrate exemplary embodiments of the present invention and together with the description serve to explain the principles of the invention.

DESCRIPTION OF THE PREFERRED EMBODIMENTS

Figure 1:
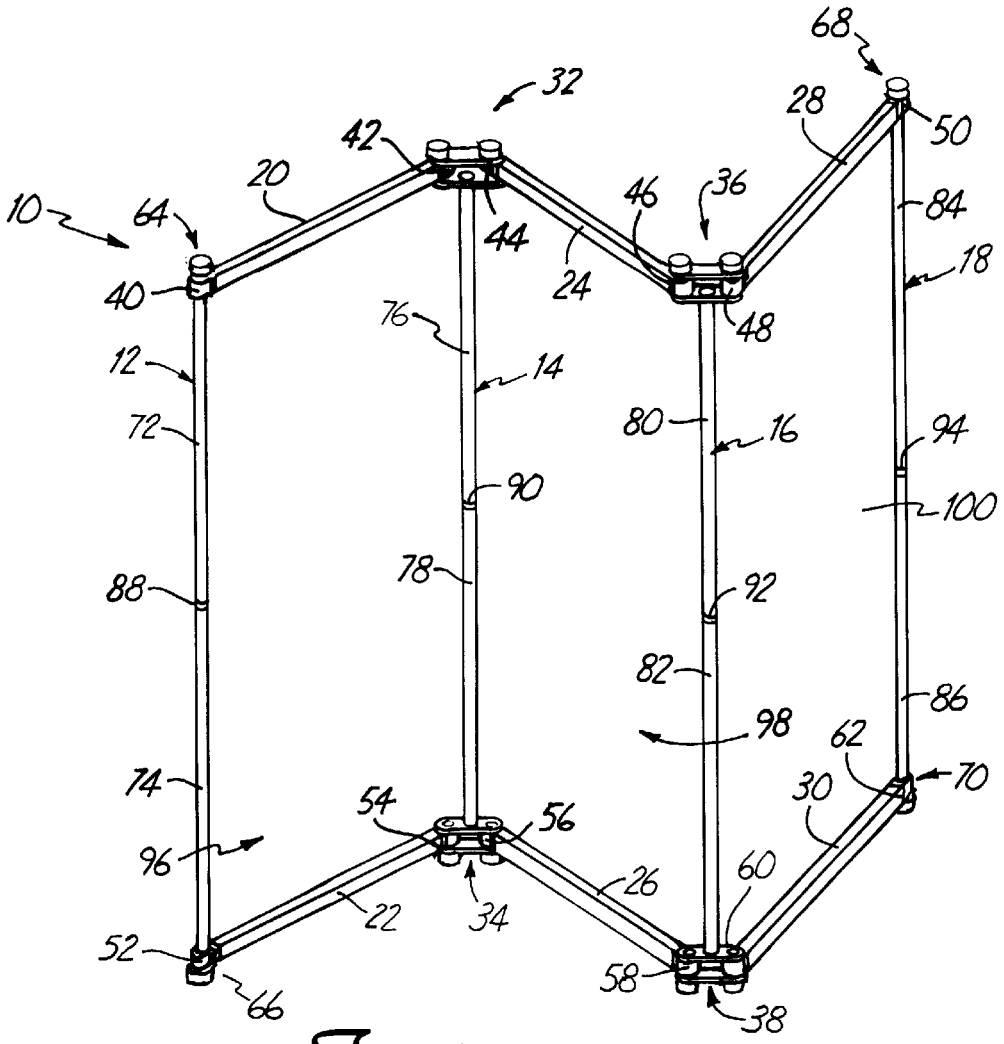
FIG. 1 is a perspective view of a children's play structure.

FIG. 1 is a perspective view of a children's play structure 10 in accordance with the present invention. As shown in FIG. 1, structure 10 includes a plurality of vertical rods 12, 14, 16, 18, and a plurality of horizontal rods 20, 22, 24, 26, 28, 30. The variety of rods shown in FIG. 1 may be provided, for example, as individual pieces in a kit for assembly and disassembly. Vertical rods 14, 16 may be referred to herein as vertical hinge rods, vertical rods 12, 18 may be referred to as vertical end rods, horizontal rods 20, 24, 28 may be referred to as upper horizontal rods, and horizontal rods 22, 26, 30 may be referred to as lower horizontal rods.

FIG. 1 also shows a plurality of first mounting structures 32, 34, 36, 38 disposed at ends of vertical hinge rods 14, 16, a plurality of second mounting structures 40, 42, 44, 46, 48, 50, 52, 54, 56, 58, 60, 62 disposed at ends of horizontal rods 20–30, and a plurality of third mounting structures 64, 66, 68, 70 disposed at ends of vertical end rods 12, 18. In one embodiment, vertical rods 12, 14, 16, 18 may comprise one of more rod segments 72, 74, 76, 78, 80, 82, 84, 86. In this case, each rod may include a coupling structure 88, 90, 92, 94 that is attached to a pair of segments 72–86 to thereby couple the first and second segments together.

The vertical end rods, vertical hinge rods, and upper and lower horizontal rods together provide a free-standing play structure 10. Further, the various rods shown in FIG. 1 are coupled to one another in a manner defining a plurality of panel mounting areas 96, 98, 100. Specifically, a combination of two vertical rods and two horizontal rods is sufficient to provide a panel mounting area. Panel mounting areas 96, 98, 100 can be uniform in size or vary relative to one another. In either case, the dimensions of the adjoining vertical and horizontal rods dictate the dimensions of respective mounting areas 96, 98, 100. First and second mounting structures 32–38 and 42, 44, 46, 48, 54, 56, 58, 60, respectively, enable horizontal rods 20–30 to be pivoted about vertical hinge rods 14, 16. In this manner, panel mounting areas 96–100 can be moved relative to one another. Thus, structure 10 is susceptible to adjustment to realize a variety of positions and can be folded for convenient storage. To extend structure 10 to include additional panel mounting areas, additional vertical hinge rods may be added along with upper and lower horizontal rods. Thus, although FIG. 1 shows four vertical rods and three resulting panel mounting areas, the extent of structure 10 could be increased almost infinitely by the incorporation of additional vertical hinge rods and upper and lower horizontal rods. However, only two vertical end rods need be used in a given structure 10 to form the first and final vertical rods, respectively.

Interchangeable panels depicting a variety of play scenes can be mounted within each panel mounting area to provide a background for child's play. If desired, structure 10 can be adjusted to provide a generally enclosed play area framed by such panels. An example of children's play structure incorporating a variety of panel configurations suitable for use with structure 10 of the present invention is disclosed in United States patent application Ser. No. 08/732,189, abandoned, entitled "CHILDREN'S PLAY STRUCTURE," the entire content of which is incorporated herein by reference.

Figure 2:
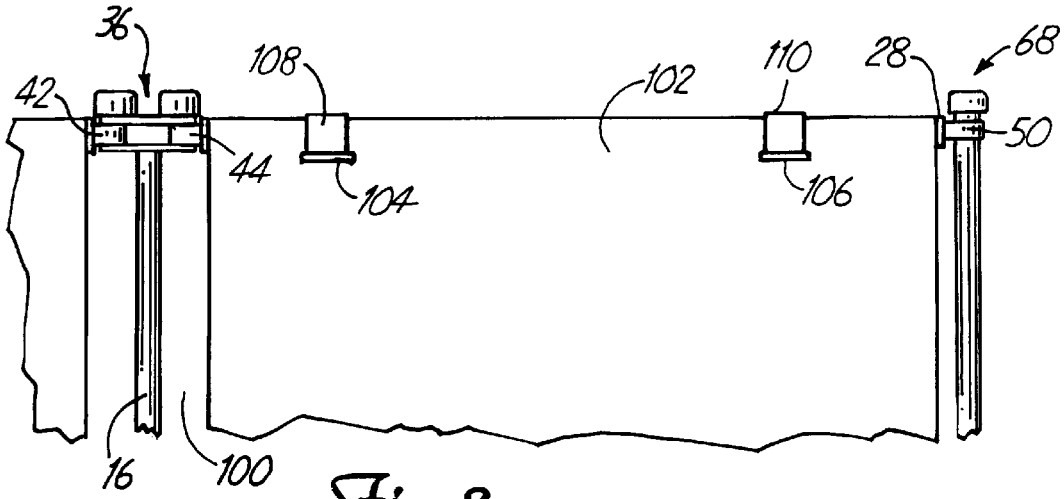
FIG. 2 is a partial front view of a portion of the children's play structure of FIG. 1 incorporating an interchangeable panel depicting a play scene.

FIG. 2 is a partial front view of a portion of the children's play structure 10 of FIG. 1 incorporating in panel mounting area 100 an interchangeable panel 102 that could depict a play scene. Panel 102 is generally planar and can be made from any of a variety of lightweight, durable, resilient materials. Panel 102 may be mounted within panel mounting area 100 in a number of ways. As shown in FIG. 2, for example, panel 102 may include two or more fastening apertures 104, 106 through which a band-like fastener 108, 110 may be inserted. The fasteners 108, 110 may comprise bands that extend about upper horizontal rod 28 and fasten to themselves via a hook-and-loop material. A similar fastening arrangement can be provided to fasten panel 102 to lower horizontal rod 30 (not shown in FIG. 2).

Figure 3:
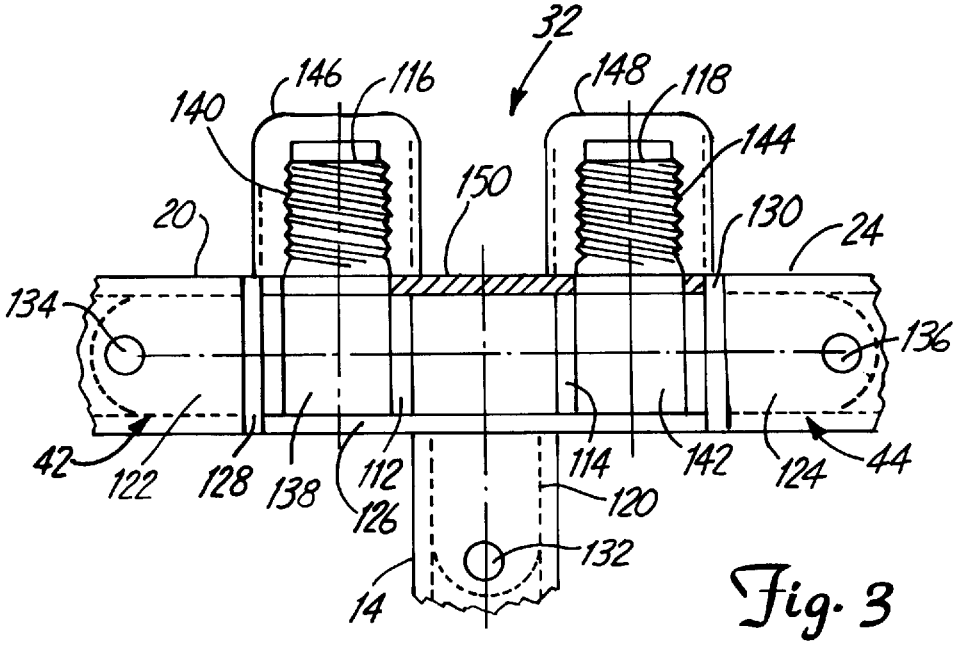
FIG. 3 is a cross-sectional side view illustrating engagement of first and second mounting structures that enable pivotable mounting of portions of the play structure for adjustable positioning and folding.
Figure 4:
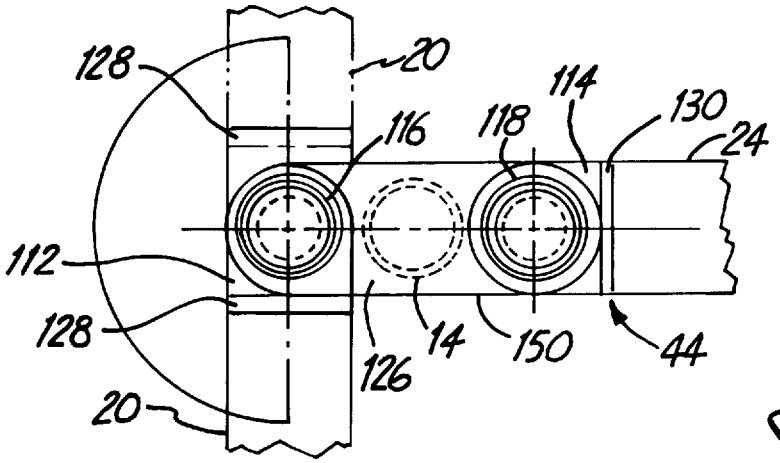
FIG. 4 is a top view of the first and second mounting structures of FIG. 3.

FIG. 3 is a cross-sectional side view illustrating engagement of first mounting structure 32 and second mounting structures 42, 44, in accordance with the present invention. FIG. 4 is a top view of the arrangement of FIG. 3, and further illustrates the pivoting of upper horizontal rod 20 about vertical hinge rod 14. The cross-section of vertical hinge rod 14 is shown in FIG. 4 through a base plate 126 in dotted lines. First and second mounting structures 32–38 and 42, 44, 46, 48, 54, 56, 58, 60 facilitate pivotable mounting of portions of play structure 10 for adjustable positioning and folding. As shown in FIGS. 3 and 4, first mounting structure 32 includes first and second mounting posts 116, 118, whereas second mounting structures 42, 44 include mounting rings 112, 114, respectively. Each mounting ring 112, 114 engages one of mounting posts 116, 118 in a pivotable manner. Thus, first mounting structure 32 provides a post 116, 118 for each of mounting rings 112, 114. In this manner, horizontal bars 20, 24 can be mounted at the same level. Further, horizontal rods 20, 24 can be pivoted freely and independently of one another. Each mounting ring 112, 114 includes an aperture through which a respective mounting post 116, 118 protrudes to secure the ring against lateral movement in a horizontal plane. In FIGS. 3 and 4, for example mounting ring 112 is retained by mounting post 116 and mounting ring 114 is retained by mounting post 118.

Each of first mounting structures 32–38 can be integrally formed with vertical hinge rods 14, 16 by, for example, molding each of the rods as single pieces that include the respective mounting structures. Second mounting structures 40–62 can be realized in a similar, integral manner with horizontal rods 20–30. First and second mounting structures 32–38 and 40–62 preferably are formed, however, as discrete elements that are configured for engagement with a respective rod upon assembly of structure 10. In particular, each of first and second mounting structures 32–38 and 40–62 can be configured for snap-fit engagement with a respective rod upon assembly, as will be described. Thus, each rod can be made at least partially hollow, or tubular, to receive part of a respective mounting structure. The cross-section of each rod may be a variety of shapes such as, for example, a square, rectangle, circle, or oval. It is further noted that each rod may be formed from, for example, a material including a semi-rigid plastic such as acrylonitrile butadiene styrene resin (ABS), or a lightweight metal such as aluminum.

As shown in FIGS. 3 and 4, vertical hinge rod 14 receives a shank portion 120 of first mounting structure 32. Similarly, second mounting structures 42, 44 include shank portions 122, 124 that are received by horizontal rods 20, 24, respectively. Attached to shank portion 120 of vertical rod 14 is a base plate 126 that supports and is attached to mounting posts 116, 118. Shank portions 122, 124 of horizontal rods 20, 24 also include base plates 128, 130, respectively, that are attached to mounting rings 112, 114. For snap-fit engagement, rods 14, 20, 24 each may include one or more apertures that receive protrusions formed on shank portions 120, 122, 124, respectively. The apertures and protrusions together serve to lock mounting structures 32, 42, 44, respectively, into place. FIG. 3 shows an aperture 132 in vertical hinge rod 14, and apertures 134, 136 in horizontal rods 20, 24, respectively. The snap-fit structure of first and second mounting structures 32, 42, 44 will be described in more detail below. As an alternative to a snap-fit engagement, the various mounting structures and rods could be configured for friction-fit engagement or adhesively bonded to one another.

With further reference to FIG. 3, each of first and second mounting posts 116, 118 includes a receiving portion and a threaded portion. For example, first mounting post 116 includes a receiving portion 138 proximal base plate 126 and a threaded portion 140 distal base plate 126. Similarly, second mounting post 118 includes a receiving portion 142 proximal base plate 126 and a threaded portion 144 distal base plate 126. The receiving portions 138, 142 receive mounting rings 112, 114, respectively. The threaded portions 140, 144 receive retainer caps 146, 148. Disposed underneath retainer caps 146, 148 is a retainer plate 150. The retainer plate 150 includes a pair of apertures through which mounting posts 116, 118 extend. The retainer caps 146, 148 can be removably coupled to mounting posts 116, 118, respectively. Specifically, retainer caps 146, 148 are counter-threaded to screw down on threaded portions 140, 144, respectively, thereby holding retainer plate 150 against mounting rings 112, 114. In this manner, mounting rings 112, 114 are secured against vertical movement relative to vertical hinge bar 14. However, retainer plate 150 allows mounting rings 112, 114 to rotate for pivotable movement about vertical hinge rod 14.

Figure 5A:
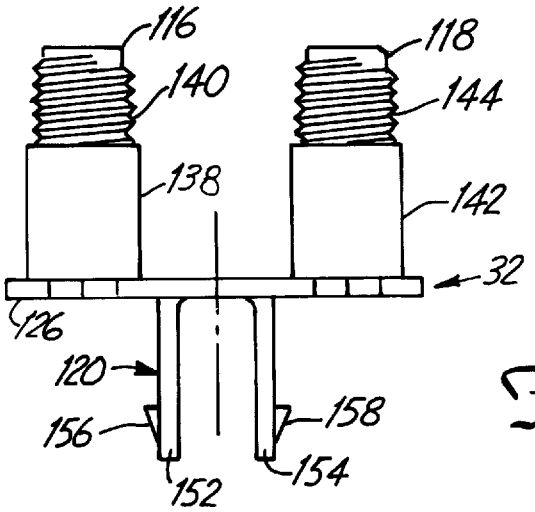
FIG. 5A is a side view of the first mounting structure of FIG. 3.
Figure 5C:
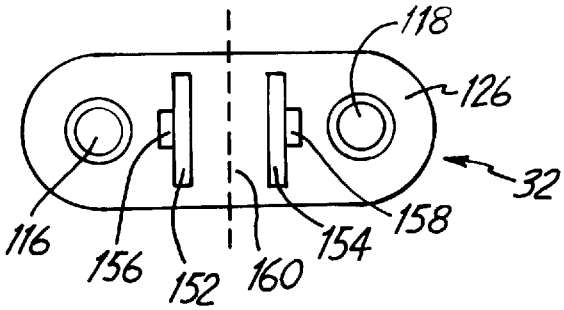
FIG. 5C is a bottom view of the first mounting structure of FIG. 3.
Figure 5D:
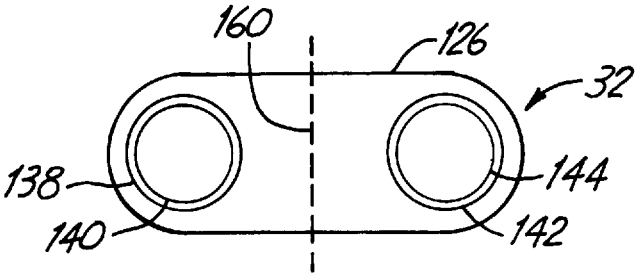
FIG. 5D is a top view of the first mounting structure of FIG. 3.
Figure 5B:
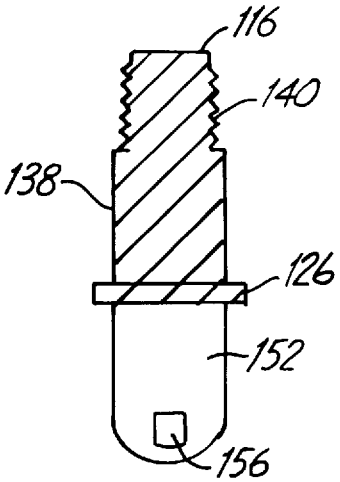
FIG. 5B is an end view of the first mounting structure of FIG. 3.

FIGS. 5A–5D show various views of first mounting structure 32 of FIG. 3. FIG. 5A provides a side view. FIG. 5B is an end view. FIGS. 5C and 5D are bottom and top views respectively. As shown in FIG. 5A, the snap-fit engagement of first mounting structure 32 to vertical hinge rod 14 can be realized, for example, by dividing shank 120 into a first shank member 152 and a second shank member 154. Shank member 152 includes a snap-fit protrusion 156, whereas shank member 154 includes a snap-fit protrusion 158. Shank members 152, 154 preferably comprise a semi-rigid material such as plastic that is capable of deforming slightly with applied force. A suitable plastic may comprise, for example, acrylonitrile butadiene styrene resin (ABS). As shank 120 is inserted into vertical hinge rod 14, protrusions 156, 158 bear against the interior wall of the tubular rod, causing shank members 152, 154 to bend inward slightly. The bending provides a small amount of clearance, enabling protrusions 156, 158 to fit within vertical hinge rod 14 and slide downward until each engages an aperture in the wall of the rod, such as aperture 132 shown in FIG. 3. As shown in FIG. 5A, protrusions 156, 158 preferably are sloped to go from narrowest to broadest as shank members 152, 154 are inserted in vertical hinge rod 14. Upon engagement, the bending pressure on shank members 152, 154 is released, and the pressure of recovery causes protrusions 156, 158 to lock into place within the apertures. In this manner, shank members 152, 154 and protrusions 156, 158 combine with the apertures to hold first mounting structure 32 in place in a snap-fit engagement relative to vertical hinge rod 14.

As shown in FIG. 5B, snap-fit protrusion 156 can be disposed near the bottom of shank member 152. Base plate 126 abuts the top of vertical hinge rod 14 and prevents further insertion of first mounting structure 32. Thus, the aperture oriented to receive protrusion 156 can be formed in vertical hinge rod 14 at a distance corresponding to the distance between the bottom of base plate 126 and protrusion 156. With reference to FIGS. 5C and 5D, mounting posts 116, 118 can be formed equidistant from a center line 160 of base plate 126. As shown in the bottom view of FIG. 5C, mounting posts 116, 118 can be formed as discrete pieces that are inserted into apertures formed in base plate 126 and held, for example, by adhesive bonding. However, mounting posts 116, 118 preferably are molded integrally with base plate 126 and the entire first mounting structure 32. The threaded portions 140, 144 can be molded into mounting posts 116, 118 or molded and subjected to a post-mold milling process. Shank members 152, 154 are shown in FIGS. 5A and 5C as being generally straight for insertion into a vertical hinge rod having a square or rectangular cross section, but can have varying shapes to conform to vertical hinge rods having different types of cross sections. For example, shank members 152, 154 can be rounded for insertion into a vertical hinge rod having a circular cross-section.

Figure 6A:
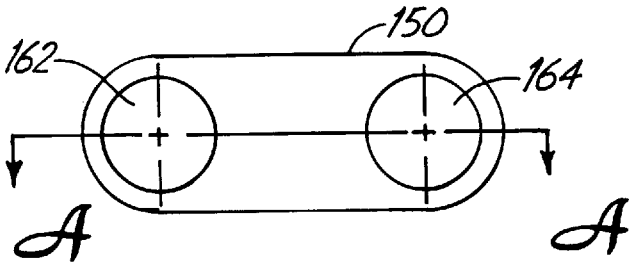
FIG. 6A is a top view of a retainer plate used with the first mounting structure of FIG. 3.
Figure 6B:
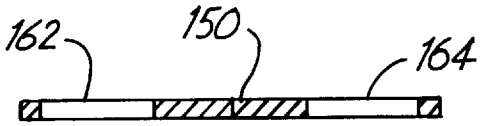
FIG. 6B is a cross-sectional side view of the retainer plate of FIG. 6A taken along line A—A.

FIGS. 6A and 6B is a top view of retainer plate 150, described above with respect to first mounting structure 32 of FIG. 3. FIG. 6B is a cross-sectional side view of the retainer plate 150 of FIG. 6A taken along line A—A. As shown in FIGS. 6A and 6B, retainer plate 150 includes a pair of apertures 162, 164 through which mounting posts 116, 118 protrude, respectively. In practice, mounting rings 112, 114 are placed over mounting posts 116, 118 such that the rings are secured about receiving portions 138, 142. Then, retainer plate 150 is placed over mounting posts 116, 118 such that the retainer plate rests on top of mounting rings 112, 114. The retainer caps 146, 148 then are screwed down on threaded portions 140, 144 of mounting posts 116, 118, respectively. In this manner, retainer caps 146, 148 serve to hold retainer plate 150 against mounting rings 112, 114, securing the rings against movement in a vertical direction. At the same time, receiving portions 138, 142 secure mounting rings 112, 114 against movement in a horizontal plane. However, retainer plate 150 and receiving portions 138, 142 allow mounting rings 112, 114 and thus horizontal rods 20, 24 to pivot about vertical hinge rod 14.

Figure 7D:
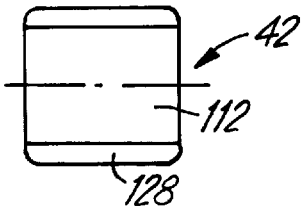
FIG. 7D is a top view of the second mounting structure of FIG. 7A.
Figure 7A:
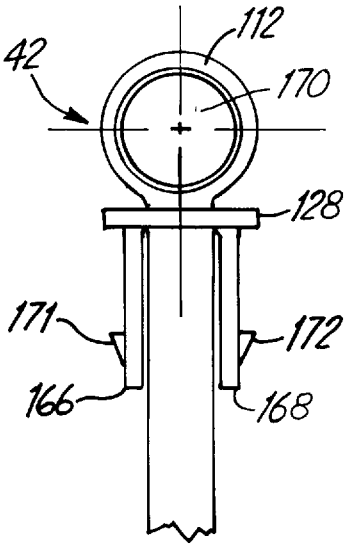
FIG. 7A is an end view of a second mounting structure.
Figure 7B:
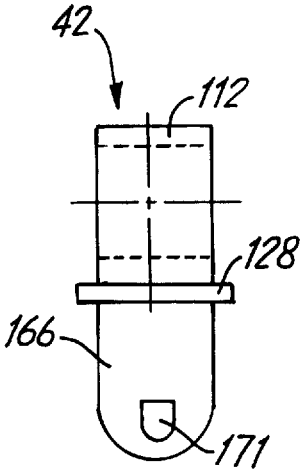
FIG. 7B is a side view of the second mounting structure of FIG. 7A.
Figure 7C:
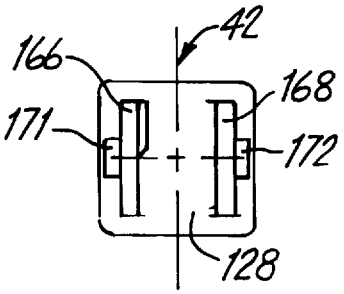
FIG. 7C is a bottom view of the second mounting structure of FIG. 7A.

FIGS. 7A–7D are various views of one of second mounting structures 40–62. In particular, FIG. 7A is an end view, FIG. 7B is a side view, and FIGS. 7C and 7D are bottom and top views, respectively. The second mounting structure in FIGS. 7A–7D is identified by reference numeral 42. As shown in FIG. 7A, second mounting structure 42 includes mounting ring 112, base plate 128, and a shank member divided into shank portions 166, 168. Mounting ring 112 includes an aperture 170 that is occupied by the receiving portion 138, 142 of one of mounting posts 116, 118 incorporated in a first mounting structure 32–38. As in first mounting structure 32 of FIG. 3, each of shank portions 166, 168 of second mounting structure 42 includes a snap-fit protrusion 171, 172 for engagement with respective snap-fit apertures formed in a horizontal rod 20. One of the snap-fit apertures 134, 136 is shown in FIG. 3 in each of horizontal rods 20, 24, respectively. Shank portions 166, 168 preferably are formed from a semi-rigid material such as plastic that is capable of slight deformation to allow insertion into horizontal rod 20. As with first mounting structure 32, a suitable plastic may comprise, for example, acrylonitrile butadiene styrene resin (ABS). Further, snap-fit protrusions 171, 172 may be sloped to facilitate insertion and locking in the apertures formed in horizontal rod 20. Like first mounting structure 32, second mounting structure 42 preferably is integrally molded as a single piece. However, mounting ring 112 and shank portions 166, 168 could be formed separately and bonded to base plate 128 by, for example, adhesive. Further, shank portions 166, 168 can be shaped to conform to the cross-section of the respective rod into which it is inserted.

Figure 8A:
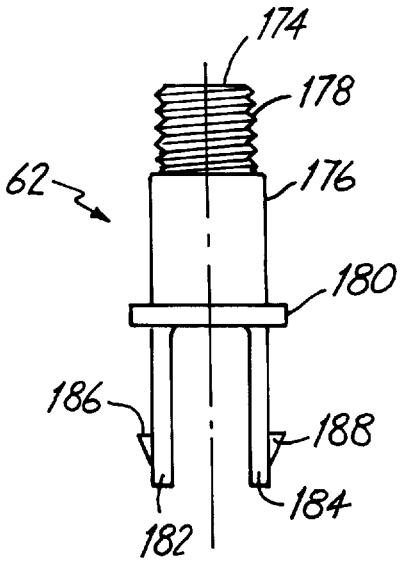
FIG. 8A is an end view of a third mounting structure.
Figure 8B:
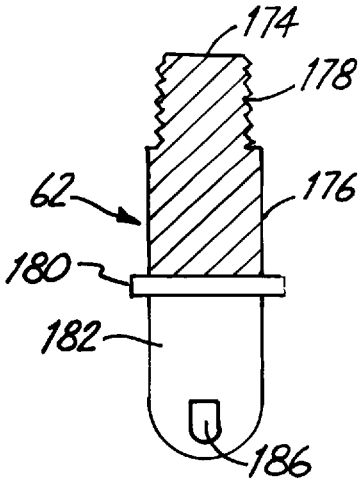
FIG. 8B is a side view of the third mounting structure of FIG. 8A.
Figure 8C:
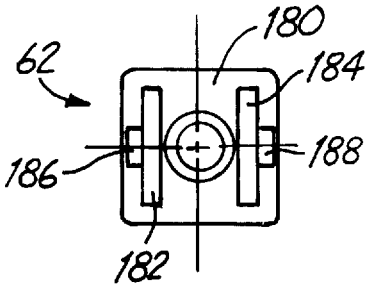
FIG. 8C is a bottom view of the third mounting structure of FIG. 8A.
Figure 8D:
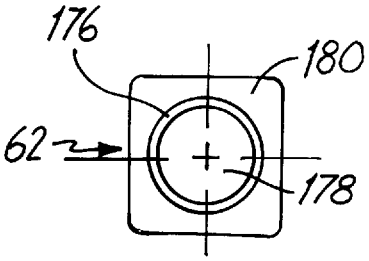
FIG. 8D is a top view of the third mounting structure of FIG. 8A.

FIGS. 8A–8D are various views of one of third mounting structures 64–70. In particular, FIG. 8A is an end view, FIG. 8B is a side view, and FIGS. 8C and 8D are bottom and top views, respectively. For illustration, the third mounting structure is identified in FIGS. 8A–8D by reference numeral 62. As shown in FIG. 8A, third mounting structure 62 includes a single mounting post 174 having a receiving portion 176 and a threaded portion 178, a base plate 180, and a shank member having a pair of shank portions 182, 184. Shank portions 182, 184 include snap-fit protrusions 186, 188, respectively, for snap-fit engagement with snap-fit apertures formed in vertical end rod 12. Shank portions 182, 184 can be shaped to conform to the cross-section of the respective rod into which it is inserted. Again, shank portions 182, 184 preferably are formed from a semi-rigid material such as, for example, acrylonitrile butadiene styrene resin (ABS). Further, snap-fit protrusion 186, 188 may be sloped to facilitate insertion and locking in the apertures formed in vertical end rod 12. Like first and second mounting structures 32, 42, third mounting structure 62 preferably is integrally molded as a single piece. Further, like first mounting structure 32, single mounting post 174 is configured to receive a mounting ring about receiving portion 176, followed by a retainer cap (not shown in FIGS. 8A–8D) that is screwed down over threaded portion 178 to retain the mounting ring. The mounting ring may be mounted to be pivotable about post 174. In light of the pivotability of mounting rings about the mounting posts of first mounting structures 32–38, however, pivotability at post 174 is not necessary.

Figure 9A:
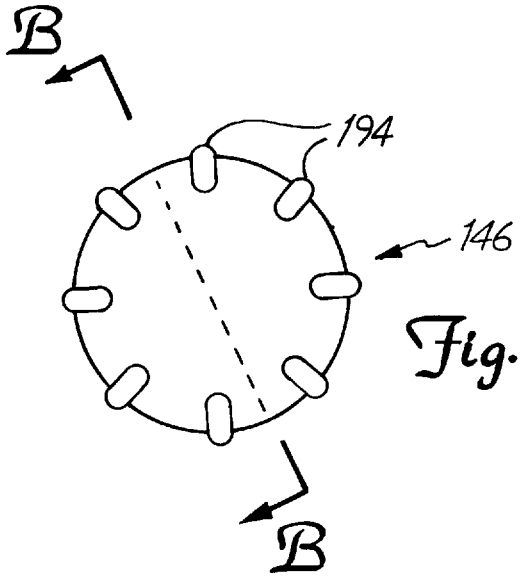
FIG. 9A is a top view of a retainer cap for use with the first or second mounting structures of FIGS. 3, 7A–7D, and 8A–8D.
Figure 9B:
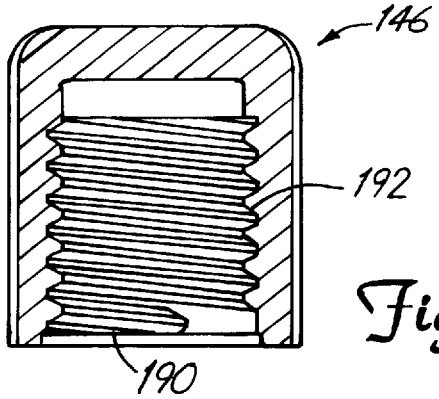
FIG. 9B is a cross-sectional side view of the retainer cap taken along line B—B of FIG. 9A.
Figure 9C:
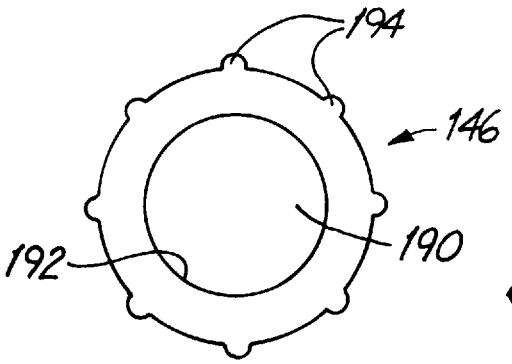
FIG. 9C is a bottom view of the retainer cap of FIG. 9A.

FIGS. 9A–9C are various views of a retainer cap for use with the first or third mounting structures of FIGS. 3, 5A–5D, and 8A–8D. In particular, FIG. 9A is a top view, FIG. 9B is a cross-sectional side view taken along line B—B of FIG. 9A, and FIG. 9C is a bottom view. As shown in FIGS. 9A–9C, retainer cap 146 is generally cylindrical in shape with an aperture 190 leading to an inner area having a threaded inner wall 192. The threads on inner wall 192 are oriented to enable retainer cap 146 to be screwed down on a respective mounting post of first mounting structure 42–48 or third mounting structure 64–70. The retainer cap 146 thereby retains a mounting ring of one of second mounting structures 40–62 on the respective mounting post. The entire retainer cap 146 may be formed from plastic, and molded to incorporate the inner area and threaded inner wall 192. However, threaded inner wall 192 alternatively may be formed by a post-mold milling process. As a further alternative, for enhanced durability, threaded inner wall 192 may be realized by a milled metal sleeve that is inserted into aperture 190 and held by compression or adhesive. If desired, the mold may be configured to impart tactile structures 194 for enhanced grip when turning retainer cap 146.

Figure 10C:
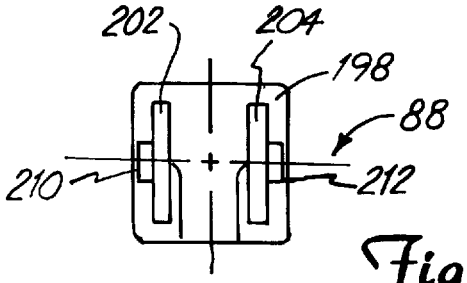
FIG. 10C is an end view of one end of the coupling structure of FIG. 10A.
Figure 10B:
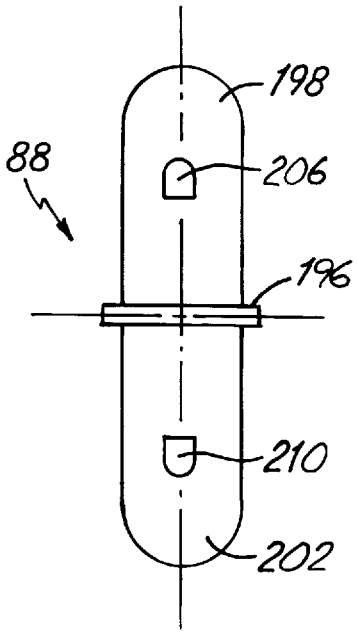
FIG. 10B is another side view of the coupling structure of FIG. 10A.
Figure 10A:
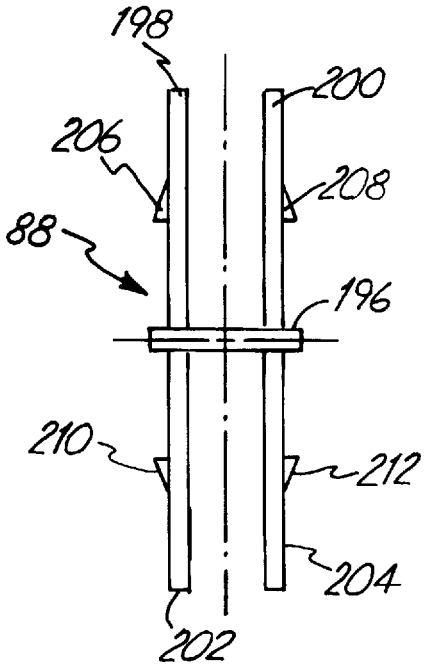
FIG. 10A is a side view of a coupling structure.

FIGS. 10A–C are various views of a coupling structure in accordance with the present invention. In particular, FIG. 10A is a side view, FIG. 10B is another side view, and FIG. 10C is an end view of one end of the coupling structure. In FIGS. 10A–10C, the coupling structure is identified by reference numeral 88. As discussed with reference to FIG. 1, a coupling structure in a children's play structure in accordance with the present invention serves to couple two segments of a vertical end rod 12, 18 or vertical hinge rod 14, 16 together. In this manner, the segments can be packaged and/or stored within a smaller box or space, and coupled together to assemble a much larger play structure 10. In FIG. 1, for example, coupling structure 88 couples rod segments 72, 74. As shown in FIG. 10A, coupling structure 88 includes a base plate 196, and a pair of shank members, each having a pair of shank portions 198, 200 and 202, 204. Each shank portion 198, 200, 202, 204 includes a respective snap-fit protrusion 206, 208, 210, 212, and may be shaped to conform to the cross-section of particular rod segments into which they are inserted. The protrusions 206, 208, 210, 212 engage snap-fit apertures formed in rod segments 72, 74 upon insertion of coupling structure 88 into each of the rod segments. The base plate 196 abuts the coupled ends of both rod segments and stabilizes the connection. Protrusions 206, 208, 210, 212 may be sloped such that a narrower portion of the protrusions engage the inner wall of the rod segment first upon insertion. Shank members 198, 200, 202, 204 can be made from a semi-rigid plastic such as, for example, acrylonitrile butadiene styrene resin (ABS), to allow slight deformation upon insertion into rod segments 72, 74. The deformation facilitates insertion. The pressure of recovery facilitates the snap-fit locking engagement of protrusions 206–212 in the snap-fit apertures provided in rod segments 72, 74.

Figure 11:
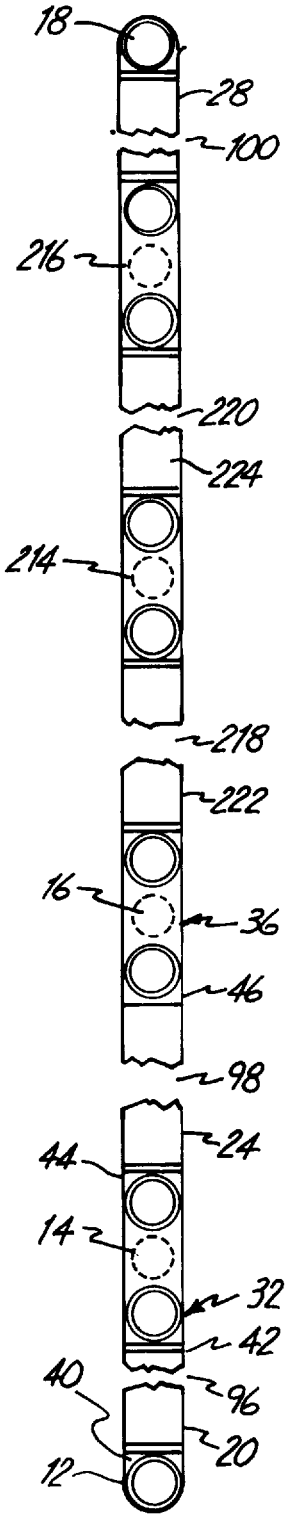
FIG. 11 is a top view of a children's play structure in an elongated, fully extended position.

FIG. 11 is a top view of children's play structure 10, in accordance with the present invention, in an elongated, fully extended position. In the example of FIG. 11, play structure 10 includes two vertical end rods 12, 18, and four vertical hinge rods 14, 16, 214, 216. Thus, structure 10 defines five separate panel mounting areas 96, 98, 100, 218, and 220 for the mounting of interchangeable panels depicting play scenes as shown in FIG. 2. In this example, to connect vertical rods 12, 14, 16, 18, 214, and 216, structure 10 further includes five upper horizontal rods 20, 24, 28, 222, 224, and five lower horizontal rods (not shown). As shown in FIG. 11, upper horizontal rod 20 extends between vertical end rod 12 and vertical hinge rod 14. At one end, a second mounting structure 40 of upper horizontal rod 20 is coupled to a third mounting structure 64 of vertical end rod 12, whereas, at another end, a second mounting structure 42 of upper horizontal rod 20 is coupled to a first mounting structure 32 of vertical hinge rod 14 via a first mounting post. Another upper horizontal rod 24 extends between vertical hinge rod 14 and vertical hinge rod 16. Upper horizontal rod 24 includes a second mounting structure 44 that is coupled to first mounting structure 32 of vertical hinge rod 14 via a second mounting post, and a second mounting structure 46 that is coupled to a first mounting structure 36 of vertical hinge rod 16 via a first mounting post. The remaining horizontal rods 28, 222, 224 are coupled between respective vertical rods in a similar manner.

Figure 12:
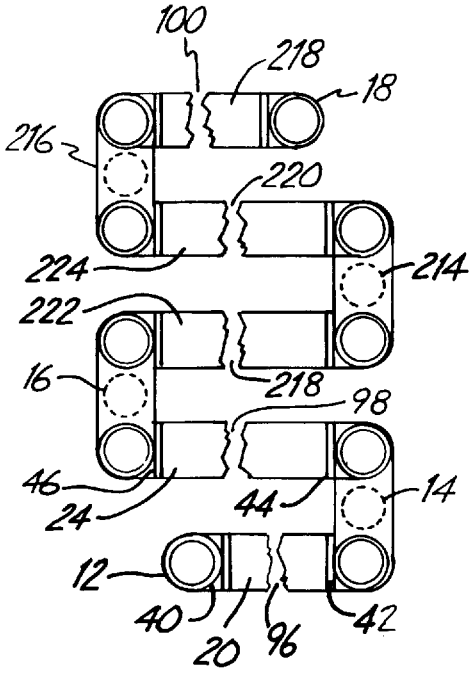
FIG. 12 is a top view of a children's play structure in a folded position.

FIG. 12 is a top view of a children's play structure, in accordance with the present invention, in a folded position. As shown in FIG. 12, each horizontal bar 20, 24, 28, 222, 224 is pivoted about a mounting post of one of first mounting structures 32, 36, 214, 216 to fold structure 10. Thus, when not in use, structure 10 may be folded into a compact structure to facilitate transportation and storage.

Figure 13:
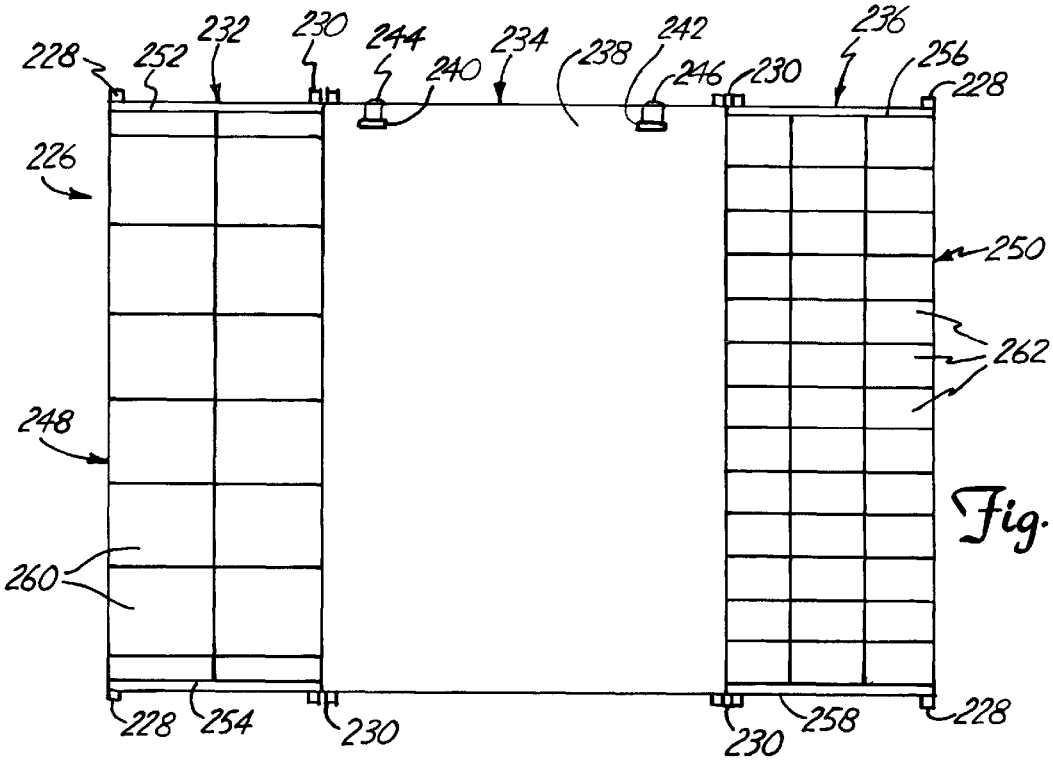
FIG. 13 is a perspective view of a children's play structure incorporating pocketed display sheets.

FIG. 13 is a perspective view of a children's play structure 226 incorporating pocketed display sheets, in accordance with an embodiment of the present invention. Structure 226 includes a frame of which first and third mounting structures 228, 230, respectively, are visible in FIG. 13. The frame and mounting structures 228, 230 may conform substantially to those described with reference to FIGS. 1–12. Structure 226 includes a plurality of panel mounting areas 232, 234, 236 that are pivotably coupled to one another via the frame and mounting structures. Panel mounting areas 232, 234, 236 can be uniform in size or vary in size relative to one another. As shown in FIG. 13, for example, mounting area 234 may be wider than mounting areas 232, 236. A panel 238 can be mounted within any of mounting areas 232, 234, 236, but is shown within mounting area 234 in FIG. 13. Panel 238 can be mounted to the frame within is mounting area 234 via a fastening mechanism such as that described with reference to FIG. 2, e.g., fastening apertures 240, 242 through which band-like fasteners 244, 246 may be inserted and wrapped about one of the horizontal rods of the frame. As also described with reference to FIG. 2, panel 238 may include artwork depicting a variety of play scenes. Alternatively, panel 238 may be realized by a clear or colored vinyl surface, or a surface capable of receiving articles attached with adhesive tape, pins, tacks, and the like. As a further alternative, panel 238 may have a surface comprising a material capable of receiving and engaging hook-and-loop fastener materials.

Mounted within areas 232, 236 are display sheets 248, 250. Display sheets 248, 250 can be mounted to the frame in the manner in which panel 238 is mounted. Alternatively, panels (not shown) can be mounted within areas 232, 236 and provided with one or more fastening surfaces for receiving display sheets 248, 250. Each of the panels may include one or more hook-and-loop fastening surfaces, for example, that extend along an edge of the panel. Such fastening surfaces can be provided as strips at the top and bottom edges of a respective panel. Additionally, fastening strips can be provided at the lateral edges of each panel. However, the entire surface of the panel preferably comprises a material capable of receiving and engaging hook-and-loop fastener materials. As shown in FIG. 13, display sheets 248, 250 may have strips 252, 254, 256, 258 that have hook-and-loop material designed to mate with and couple to the material provided on the mounting panels. Alternatively, any of a variety of fastening mechanisms such as adhesive tape, pins, or tacks may be used. In each case, display sheets 248, 250 can be conveniently positioned and removed to provide additional variety and flexibility to the arrangement of play structure 226.

As further shown in FIG. 13, each display sheet 248, 250 includes a plurality of pockets 260, 262, respectively, for receiving and displaying articles. Pockets 260, 262 may be sized to receive, for example, drawings, reports, index cards, trading cards, photographs, and a variety of similar viewing materials. Each of pockets 260, 262 on a given display sheet 248, 250 may be sized to receive articles having similar dimensions. For photographs and index cards, for example, pockets 262 could be approximately four inches by six inches. For drawings and reports, pockets could be approximately eight and one-half by eleven inches. A single display sheet 248, 250 may include pockets 260, 262 of varying sizes. Further, different display sheets 248, 250 may include pockets 260, 262 of different dimensions. In each case, pockets 260, 262 can be made from a transparent material such as a clear, or at least translucent, vinyl to enable articles inserted and displayed in the pockets to be viewed. Panel 234 mounted between display sheets 248, 250 may include artwork that provides a theme or setting for the articles displayed in pockets 260, 262. If pockets 260, 262 contain photographs of a school trip to a zoo, for example, panel 234 may be selected to include artwork that conveys a zoo- or animal-themed background. As further examples, the artwork depicted by panel 234 could be themed as appropriate for holidays, seasons, or sports. Such artwork can be provided directly on panel 234 or via a poster sheet that can be mounted to the panel. Like display sheets 260, 262, the poster sheet can be provided with hook-and-loop fastening strips that mate with fastening surfaces on panel 234. Alternatively, any of a variety of fastening mechanisms such as adhesive tape, pins, or tacks may be used.

Figure 14:
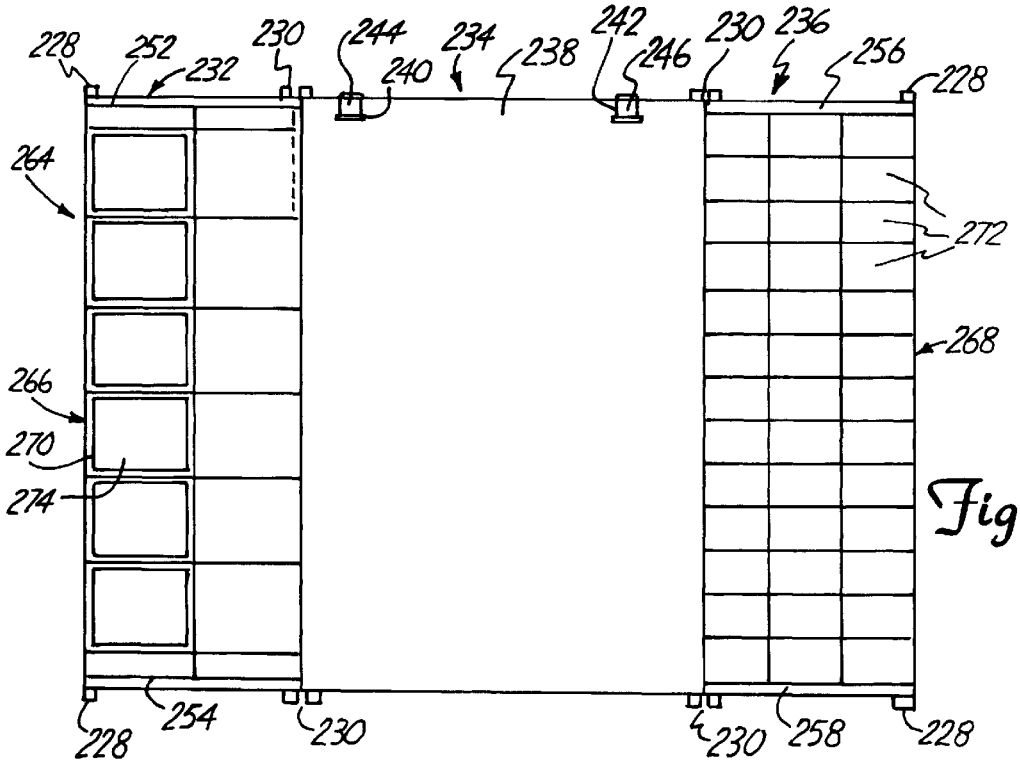
FIG. 14 is a perspective view of another children's play structure incorporating pocketed display sheets.

FIG. 14 is a perspective view of another children's play structure 264 incorporating pocketed display sheets 266, 268. The structure 264 of FIG. 14 conforms substantially to that shown in FIG. 13, but includes pockets 270, 272 having an alternative configuration. Specifically, one or more of pockets 270, 272 may include a display aperture 274 through which a received article is viewed. Display aperture 274 allows pockets 270, 272 to be formed from substantially transparent materials or substantially opaque materials. In either case, an article inserted into a pocket 270, 272 can be viewed through display aperture 274. Display aperture 274 permits the use of pockets 270, 272 made from colored, opaque materials, and may provide a border or framing effect to the displayed articles.

Figure 15:
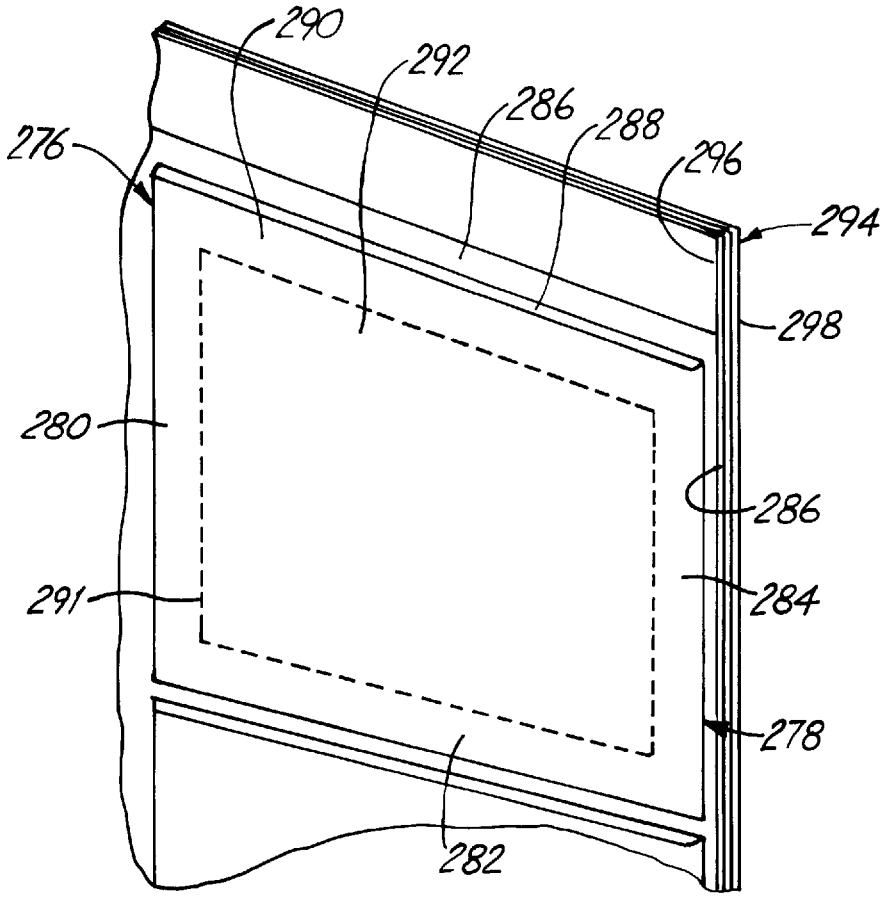
FIG. 15 is a view of a display pocket useful in the play structures of FIGS. 13 and 14.

FIG. 15 is a view of a display pocket 276 useful in the play structures 226, 264 of FIGS. 13 and 14. Pocket 276 can be formed by, for example, adhesively or thermally bonding a front flap 278 at three edges 280, 282, 284 to a substrate sheet 286. The resulting pocket 276 defines an insertion aperture 288 at the unbonded edge 290 for receipt of an article to be displayed. Bonded edges 280, 282, 284 secure the article against movement. Although FIG. 15 depicts top edge 290 as being unbonded for vertical article insertion, one or both of side edges 280, 284 could be unbonded for horizontal article insertion. In the latter case top and bottom edges 290, 282 would be bonded to substrate sheet 286. As indicated by dotted lines 291 in FIG. 15, a portion of the front flap could be removed to define a display aperture 292. In this case, the edges 280, 282, 284, 290 of front flap 278 should be wide enough to retain an article against movement but generally allow a display aperture of sufficient dimension to enable viewing of substantially the entire article. FIG. 15 also illustrates an exemplary mode of attaching a display sheet to a panel 294. As shown in FIG. 15, substrate sheet 286 may include a hook-and-loop fastening strip 296 that engages a mating hook-and-loop fastening surface 298 on panel 294.

The foregoing detailed description has been provided for a better understanding of the invention and is for exemplary purposes only. Modifications may be apparent to those skilled in the art without deviating from the spirit and scope of the appended claims.

What is claimed is:

1. A children's play structure comprising:

a plurality of vertical hinge rods, each of the vertical hinge rods including a pair of mounting posts at each of an upper and lower end of the respective vertical hinge rod:

a first vertical end rod having at least one mounting post at each of an upper and lower end of the first vertical end rod;

a second vertical end rod having at least one mounting post at each of an upper and lower end of the second vertical end rod;

a plurality of upper horizontal rods, each of the upper horizontal rods including a mounting ring at each of a first and second end of the respective upper horizontal rod; and a plurality of lower horizontal rods, each of the lower horizontal rods including a mounting ring at each of a first and second end of the respective lower horizontal rod, wherein:

at least one of the upper horizontal rods extends between one of the vertical hinge rods and another of the vertical hinge rods, the mounting ring at one end of the upper horizontal rod pivotably engaging one of the mounting posts at the upper end of the one of the vertical hinge rods and the mounting ring at the other end of one of the upper horizontal rod pivotably engaging one of the mounting posts at the upper end of the other of the vertical hinge rods, at least one of the upper horizontal rods extends between one of the vertical hinge rods and one of the vertical end rods, the mounting ring at one end of the upper horizontal rod pivotably engaging one of the mounting posts at the upper end of the vertical hinge rod and the mounting ring at the other end of the upper horizontal rod engaging the mounting post at the upper end of the vertical end rod, at least one of the lower horizontal rods extends between one of the vertical hinge rods and another of the vertical hinge rods, the mounting ring at one end of the lower horizontal rod pivotably engaging one of the mounting posts at the lower end of the one of the vertical hinge rods and the mounting ring at the other end of the lower horizontal rod engaging one of the mounting posts at the lower end of the other of the vertical end rods, and at least one of the lower horizontal rods extends between one of the vertical hinge rods and one of the vertical end rods, the mounting ring at one end of the lower horizontal rod pivotably engaging one of the mounting posts at the lower end of the vertical hinge rod and the mounting ring at the other end of the lower horizontal rod engaging the mounting post at the lower end of the vertical end rod.

2. The children's play structure of claim 1, wherein at least some of the mounting posts form parts of discrete elements that are attached to the ends of the vertical hinge rods and vertical end rods via snap-fit engagement.

3. The children's play structure of claim 1, wherein at least some of the mounting rings form parts of discrete elements that are attached to the ends of the upper horizontal rods and lower horizontal rods via snap-fit engagement.

4. The children's play structure of claim 1, wherein each of at least some of the vertical hinge rods and vertical end rods includes a first segment, a second segment, and a coupling structure, wherein the coupling structure is attached to the first and second segments via a snap-fit engagement to thereby couple the first and second segments together.

5. The children's play structure of claim 1, further comprising a plurality of caps, each of the caps being removably coupled to one of the mounting posts to secure one of the mounting rings to the mounting post.

6. The children's play structure of claim 1, further comprising at least one interchangeable panel member removably attached to at least one of the upper horizontal rods and lower horizontal rods.

7. A children's play structure comprising:

a first vertical rod having both a first mounting post and a second mounting post at each of an upper and lower end of the first vertical rod;

a second vertical rod having at least one mounting post at each of an upper and lower end of the second vertical rod;

a third vertical rod having at least one mounting post at each of an upper and lower end of the third vertical rod;

a first horizontal member having a mounting ring at each of a first and second end of the first horizontal member, wherein the mounting ring at the first end of the first horizontal member pivotably engages the first mounting post at the upper end of the first vertical rod and the mounting ring at the second end of the first horizontal member engages the mounting post at the upper end of the second vertical rod;

a second horizontal member having a mounting ring at each of a first and second end of the second horizontal member, wherein the mounting ring at the first end of the second horizontal member pivotably engages the second mounting post at the upper end of the first vertical rod and the mounting ring at the second end of the second horizontal member engages the mounting post at the upper end of the third vertical rod;

a third horizontal member having a mounting ring at each of a first and second end of the third horizontal member, wherein the mounting ring at the first end of the third horizontal member pivotably engages the first mounting post at the lower end of the first vertical rod and the mounting ring at the second end of the third horizontal member engages the mounting post at the lower end of the second vertical rod;

a fourth horizontal member having a mounting ring at each of a first and second end of the fourth horizontal member, wherein the mounting ring at the first end of the fourth horizontal member pivotably engages the second mounting post at the lower end of the first vertical rod and the mounting ring at the second end of the fourth horizontal member engages the mounting post at the lower end of the third vertical rod.

8. The children's play structure of claim 7, wherein each of the first horizontal member includes a first horizontal rod, the second horizontal member includes a second horizontal rod, the third horizontal member includes a third horizontal rod, and the fourth horizontal member includes a fourth horizontal rod.

9. The children's play structure of claim 8, wherein:

the mounting post at each of the upper and lower ends of the third vertical rod includes both a first and second mounting post, the mounting ring at the second end of the second horizontal rod engages the first mounting post at the upper end of the third vertical rod, and the mounting ring at the second end of the fourth horizontal rod pivotably engages the first mounting post at the lower end of the third vertical rod, and the structure further comprises:

a fourth vertical rod having a mounting post at each of an upper and lower end of the fourth vertical rod;

a fifth horizontal rod having a mounting ring at each of a first and second end of the fifth horizontal rod, wherein the mounting ring at the first end of the fifth horizontal rod pivotably engages the second the upper end of the third vertical rod and the mounting ring at the second end of the fifth horizontal rod engages the mounting post at the upper end of the fourth vertical rod; and a sixth horizontal rod having a mounting ring at each of a first and second end of the sixth horizontal rod, wherein the mounting ring at the first end of the sixth horizontal rod pivotably engages the second mounting post at the lower end of the third vertical rod and the mounting ring at the second end of the sixth horizontal rod engages the mounting post at the lower end of the fourth vertical rod.

10. The children's play structure of claim 8, wherein at least some of the mounting posts form parts of discrete elements that are attached to the ends of the vertical rods via snap-fit engagement.

11. The children's play structure of claim 8, wherein at least some of the mounting rings form parts of discrete elements that are attached to the ends of the horizontal rods via snap-fit engagement.

12. The children's play structure of claim 8, wherein each of at least some of the vertical rods includes a first segment, a second segment, and a coupling structure, wherein the coupling structure is attached to the first and second segments via a snap-fit engagement to thereby couple the first and second segments together.

13. The children's play structure of claim 8, further comprising a plurality of caps, each of the caps being removably coupled to one of the mounting posts to secure one of the mounting rings to the mounting post.

14. The children's play structure of claim 8, further comprising at least one interchangeable panel member removably attached to at least one of said horizontal rods.

15. A children's play structure kit comprising:

a plurality of vertical rods;

a plurality of horizontal rods;

a plurality of first mounting structures, each of the first mounting structures disposed at an end of one of the vertical rods, wherein each of the first mounting structures includes first and second mounting posts; and a plurality of second mounting structures, each of the second mounting structures disposed at an end of one of the horizontal rods, wherein each of the second mounting structures includes a mounting ring for pivotable engagement with one of the mounting posts, each of the horizontal rods thereby being at least partially pivotable about at least one of the vertical rods.

16. The children's play structure kit of the claim 15, wherein each of the first mounting structures comprises a discrete structure configured for engagement with an end of one of the vertical rods.

17. The children's play structure kit of claim 15, wherein each of the second mounting structures comprises a discrete element configured for engagement with an end of one of the horizontal rods.

18. The children's play structure kit of claim 15, wherein at least some of the first mounting structures are attached to the ends of the vertical rods via snap-fit engagement.

19. The children's play structure kit of claim 15, wherein at least some of the second mounting structures are attached to the ends of the horizontal rods via snap-fit engagement.

20. The children's play structure kit of claim 15, wherein each of at least some of the vertical rods includes a first segment, a second segment, and a coupling structure, wherein the coupling structure is attached to the first and second segments via a snap-fit engagement to thereby couple the first and second segments together.

21. The children's play structure kit of claim 15, further comprising a plurality of caps, each of the caps being removably coupled to one of the mounting posts to secure one of the mounting rings to the mounting post.

22. The children's play structure kit of claim 15, further comprising at least one interchangeable panel member removably attached to at least one of said horizontal rods.

* * * * *